US006909870B2

(12) United States Patent
Lee

(10) Patent No.: US 6,909,870 B2
(45) Date of Patent: Jun. 21, 2005

(54) FIXING APPARATUS FOR A PRINTER HAVING A PAPER SEPARATING UNIT

(75) Inventor: Bong-hee Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/412,302

(22) Filed: Apr. 14, 2003

(65) Prior Publication Data

US 2004/0018032 A1 Jan. 29, 2004

(30) Foreign Application Priority Data

Jul. 23, 2002 (KR) ..... 10-2002-0043279

(51) Int. Cl.[7] ..... G03G 15/20
(52) U.S. Cl. ..... 399/323; 271/307; 271/900
(58) Field of Search ..... 399/307, 323, 399/398, 399; 271/307, 311, 900

(56) References Cited

U.S. PATENT DOCUMENTS 4,156,524 A * 5/1979 Bar-on et al. ..... 271/311
4,408,757 A * 10/1983 Yarm ..... 271/311
5,532,810 A * 7/1996 Cahill ..... 399/323
5,802,434 A * 9/1998 Takehara et al. ..... 399/323
6,088,565 A * 7/2000 Jia et al. ..... 399/307
6,205,316 B1 * 3/2001 Iida ..... 399/323
6,456,817 B1 * 9/2002 Kamiya ..... 399/323
6,490,428 B1 * 12/2002 Fromm et al. ..... 399/323

* cited by examiner

*Primary Examiner*—Sophia S. Chen
(74) *Attorney, Agent, or Firm*—Staas & Halsey LLP

(57) ABSTRACT

A fixing apparatus for a printer includes a paper separating unit. The fixing apparatus also includes a heating unit which fixes an image on paper by heating paper passing through a developing unit, a pressing unit which contacts the heating unit, presses paper passing through an interface with the heating unit and helps to fix the image on the paper, and a paper separating unit which includes a separation member having a sharp end contacting the heating unit to separate paper, an arm member having one end to which the separation member is attached and pivots, centering on a hinge shaft at a predetermined angle, and an elastic member which is connected to the other end of the arm member and applies an elastic force so that the arm member is maintained in a correct position.

31 Claims, 6 Drawing Sheets

FIXING APPARATUS FOR A PRINTER HAVING A PAPER SEPARATING UNIT

CROSS-REFERENCE TO RELATED APPLICATIONS

This application claims the priority of Korean Patent Application No. 2002-43279, filed on Jul. 23, 2002, in the Korean Intellectual Property Office, the disclosure of which is incorporated herein in its entirety by reference.

BACKGROUND OF THE INVENTION

1. Field of the Invention

The present invention relates to a fixing apparatus for a printer, and more particularly, to a fixing apparatus for a printer, the fixing apparatus having a paper separating unit that can prevent elements from being worn and which can be manufactured at low cost.

2. Description of the Related Art

FIG. 1 is a cross-sectional view of a conventional fixing apparatus for a printer having a paper separating unit and a paper ejecting apparatus. Referring to FIG. 1, the conventional fixing apparatus includes a heating roller 11, a pressing roller 13, a paper separating unit 15, and a tension spring 17. The heating roller 11 fixes an image on paper S by heating the paper S on which the image developed by a conventional developing unit (not shown) is formed. The pressing roller 13 helps to fix the image by pressing the paper S that contacts the heating roller 11 and which is inserted in an interface with the heating roller 11. The paper separating unit 15 contacts the heating roller 11 and separates the paper S. The tension spring 17 applies an elastic force to the paper separating unit 15 and maintains the paper separating unit 15 in a correct position.

The image on the paper S passes through the fixing apparatus, is fixed on the paper S, and is then moved to the paper ejecting apparatus via a paper ejecting guide 25. The paper ejecting apparatus ejects the paper S, which is supplied while first and second ejecting rollers 21 and 23 rotate in contact with each other, to the outside.

FIG. 2 is an enlarged view of portion A of FIG. 1 and shows a contact surface between the paper separating unit 15 installed in the conventional fixing apparatus for a printer and the heating roller 11. Preferably, the conventional paper separating unit 15 should form a sharp end, to contact the heating roller 11 closely and to separate the paper. However, in general, the conventional paper separating unit 15 is formed of plastics having a blunt end, as shown in FIG. 2. In such a case, while the paper separating unit 15 operates, the surface of the heating roller 11 is damaged by the blunt end of the paper separating unit 15, causing image quality to deteriorate.

Also, since the heating roller 11 of the conventional paper separating unit 15 operates at a temperature of about 180 C, the paper separating unit 15 is formed of a material resistant to heat even at a high temperature In addition, TEFLON® is coated on the surface of the paper separating unit 15. As a result, the manufacturing cost of the paper separating unit 15 is greatly increased.

SUMMARY OF THE INVENTION

The present invention provides a fixing apparatus for a printer, the fixing apparatus having a low-cost paper separating unit which can effectively separate paper without damaging the surface of a heating roller.

Additional aspects and advantages of the invention will be set forth in part in the description which follows and, in part, will be obvious from the description, or may be learned by practice of the invention.

According to an aspect of the present invention, a fixing apparatus for a printer includes a heating unit which fixes an image on a paper by heating the paper passing through a developing unit, a pressing unit which contacts the heating unit, presses the paper passing through an interface with the heating unit and helps to fix the image on the paper, and a paper separating unit which includes a separation member. The separation member has a sharp end contacting the heating unit to separate the paper, an arm member having one end to which the separation member is attached and pivots, centering on a hinge shaft at a predetermined angle, and an elastic member which is connected to the other end of the arm member and applies an elastic force so that the arm member is maintained in a correct position. The separation member may be a leaf spring formed of a SUS-family material (SUS is the Japanese Industrial Standard grade of stainless steel) that is strongly resistant to heat, and TEFLON® may be coated on the surface of the separation member. A polyimide film may also be attached to the surface of the separation member.

The arm member is formed of a press type material forming a predetermined angle, and the separation member is attached to one end of the arm member. The elastic member is connected to the other end of the arm member, and the hinge shaft extends from the center of the arm member such that the arm member pivots, centering on the hinge shaft at a predetermined angle.

The heating unit is a heating roller. The pressing unit may be a pressing roller or a transfer roller.

The present invention provides a paper separating unit for a fixing apparatus for a printer that can prevent paper from being rolled in a direction of a heating roller and which is formed using a low-cost material, such that sheets of paper are effectively separated from the heating roller, damage to the heating roller is prevented, and a deterioration of the printing quality is prevented.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
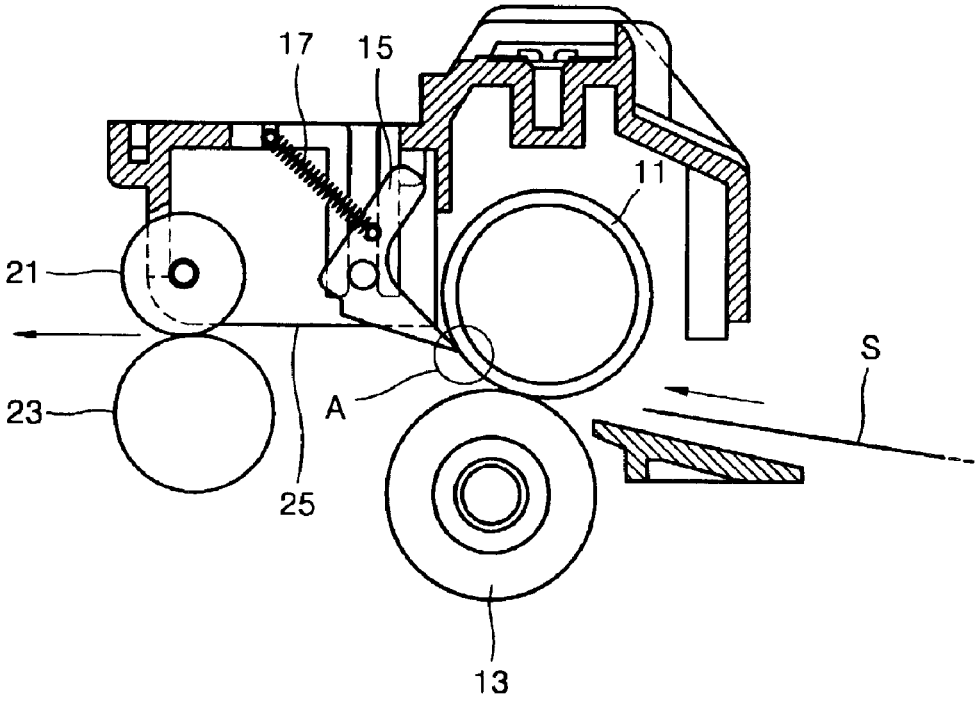
FIG. 1 (PRIOR ART)
FIG. 1 schematically shows a conventional printer.
Figure 2:
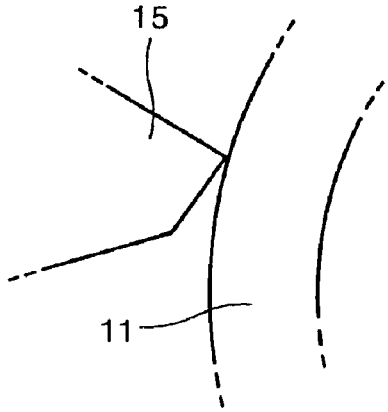
FIG. 2 (PRIOR ART)
FIG. 2 is an enlarged cross-sectional view of portion A of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, the present invention will be described in detail by describing a preferred embodiment of the invention with reference to the accompanying drawings.

Figure 3A:
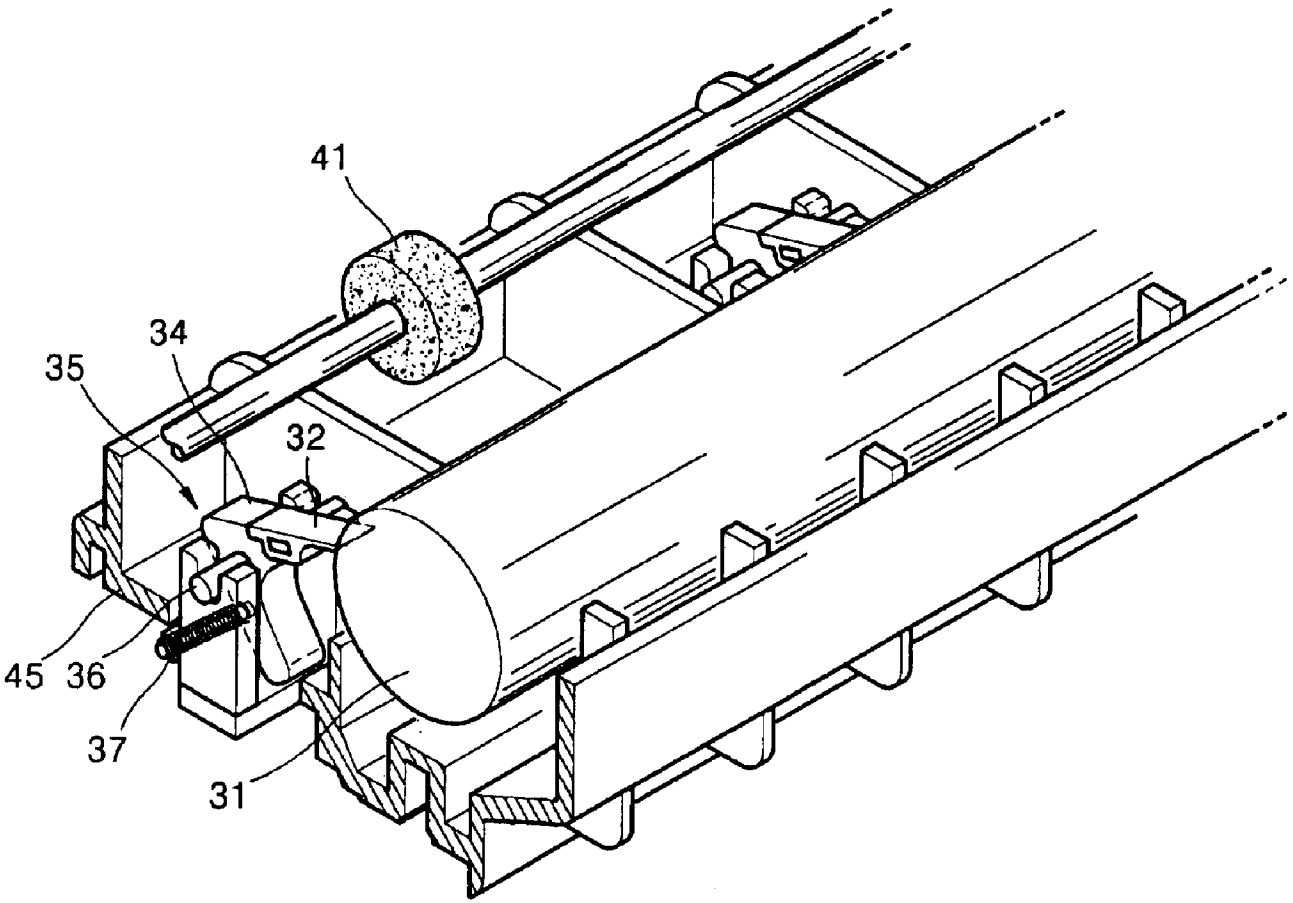
FIG. 3A is a perspective view of a fixing apparatus for a printer, according to an embodiment of the present invention.

FIG. 3A is a perspective view of a fixing apparatus for a printer, according to an embodiment of the present invention. Referring to FIG. 3A, a separation member 32 in which a sharp end extends to contact a heating roller 31 is coupled with one end of an arm member 34, and a hinge shaft 36 that extends from the center of the arm member 34 is inserted in both fixing ends, which the hinge shaft 36 pivotably contacts, and a tension spring 37 is connected to the other end of the arm member 34 and applies an elastic force to the arm member 34. A bar is inserted in a ring-shaped first ejecting roller 41 as part of a paper ejecting apparatus spaced apart from the fixing apparatus by a predetermined gap. The fixing apparatus and the paper ejecting apparatus are covered with an external housing 45.

Figure 3B:
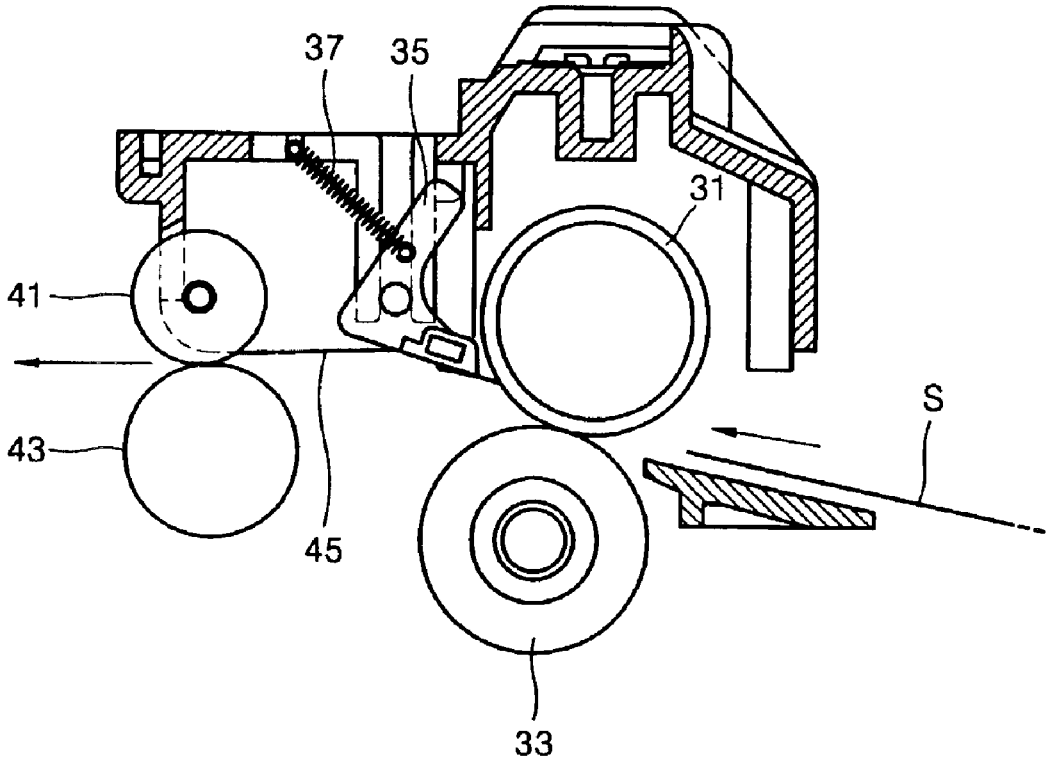
FIG. 3B is a cross-sectional view of the fixing apparatus for a printer, according to an embodiment of the present invention.

FIG. 3B is a cross-sectional view of the fixing apparatus for a printer, according to an embodiment of the present invention. Referring to FIG. 3B, the fixing apparatus to fix an image on paper S includes a heating roller 31, a pressing roller 33, and a paper separating unit 35. The fixing apparatus fixes an image on the paper S, and then the paper S is ejected through a paper ejecting apparatus.

The heating roller 31 and the pressing roller 33 rotate in contact with each other. The heating roller 31 heats the paper S so that toner particles forming an image are completely absorbed to, and fixed on, the paper S. The pressing roller 33 helps to fix the image by heat, together with the heating roller 31, by applying a pressure to the paper S. However, if the paper S is heated, the paper S can roll in a heating flux direction such that the paper S is rolled in the direction of the heating roller 31. Thus, a paper separating unit 35 is necessary to separate the paper S rolled on the surface of the heating roller 31 from the heating roller 31. Here, reference numerals 41 and 43 denote first and second ejecting rollers, respectively.

Figure 4A:
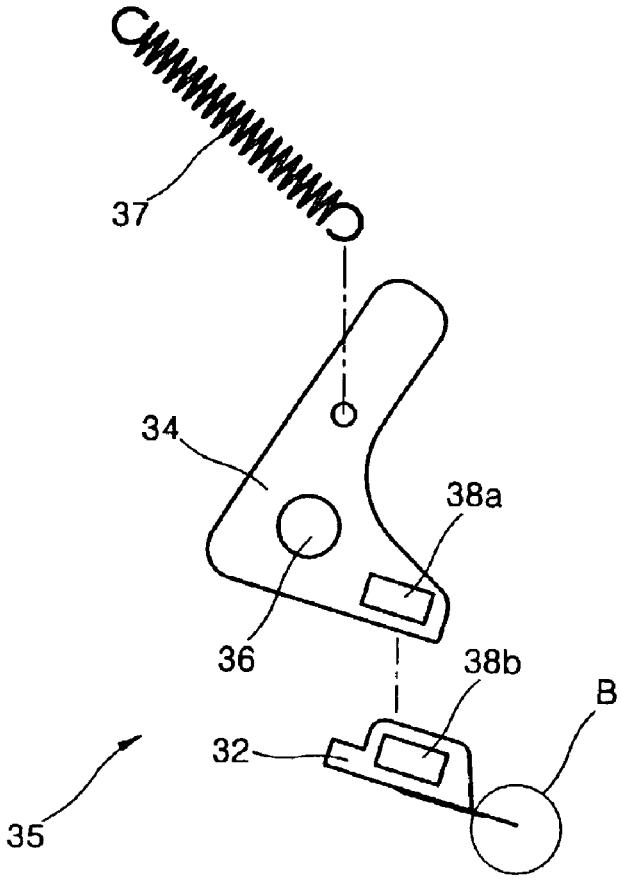
FIG. 4A is an exploded view of a paper separating unit employed in the fixing apparatus for a printer, according to the embodiment of the present invention.

FIG. 4A is an exploded view of a paper separating unit 35 employed in the fixing apparatus for a printer, according to an embodiment of the present invention. Referring to FIGS. 3B and 4A, the paper separating unit 35 includes a separation member 32 which contacts the heating roller 31 and separates the paper S from the surface of the heating roller 31, the arm member 34 formed to pivot at a predetermined angle by the hinge shaft 36, and the elastic member 37 which applies an elastic force to the arm member 34 and applies a restoring force so that the arm member 34 is maintained in a correct position.

Figure 4B:
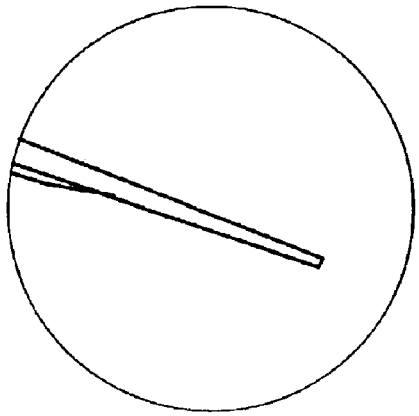
FIG. 4B is an enlarged cross-sectional view of portion B of FIG. 4A.

Referring to FIG. 4B, the separation member 32 is formed by coating TEFLON® on a member formed of a press type material, for example, an SUS-family material. The separation member 32 makes the paper S separate easily by forming a sharp and extendable end. Also, the separation member 32 is formed of a high heat-resistant material and thus is not deformed by contact with the heating roller 31. As shown in FIG. 4A, a groove 38*b* to be engaged with a protrusion 38*a* is formed in a body part of the separation member 32 so that the separation member 32 is easily coupled with the arm member 34 in which the protrusion 38*a* is formed, attaching the separation member 32 to the arm member 34.

FIG. 4B is an enlarged cross-sectional view of portion B of FIG. 4A, presenting an enlarged end of the separation member 32 of FIG. 4A. As shown in FIG. 4B, the paper separating unit 35 employed in the fixing apparatus for a printer, according to the embodiment of the present invention, unlike the conventional paper separating unit, forms a sharp and extendable end contacting the heating roller 31, and thus makes the paper S separate more easily from the heating roller 31.

The arm member 34 includes one end to which the separation member 32 is attached and the other end that extends from the one end at a predetermined angle. The arm member 34 pivots, centering on the hinge shaft 36 at a predetermined angle. The arm member 34 does not directly contact the heating roller 31, and thus can be formed of general plastics. As such, manufacturing costs can be reduced compared to the conventional paper separating unit.

The elastic member 37 is a helicoidal spring, applies an elastic force to the other end of the arm member 34 to which the separation member 32 is not attached, and transfers the elastic force to the separation member 32 through the arm member 34 such that the separation member 32 continuously contacts the surface of the heating roller 31.

The paper separating unit employed in the fixing apparatus for a printer, according to an embodiment of the present invention can prevent damage to elements due to their life spans, thus preventing a decrease in life spans of the elements and deterioration of the image quality. In addition, a high heat-resistant material used to form the paper separating unit is replaced with a press type material, thus reducing costs.

Figure 5:
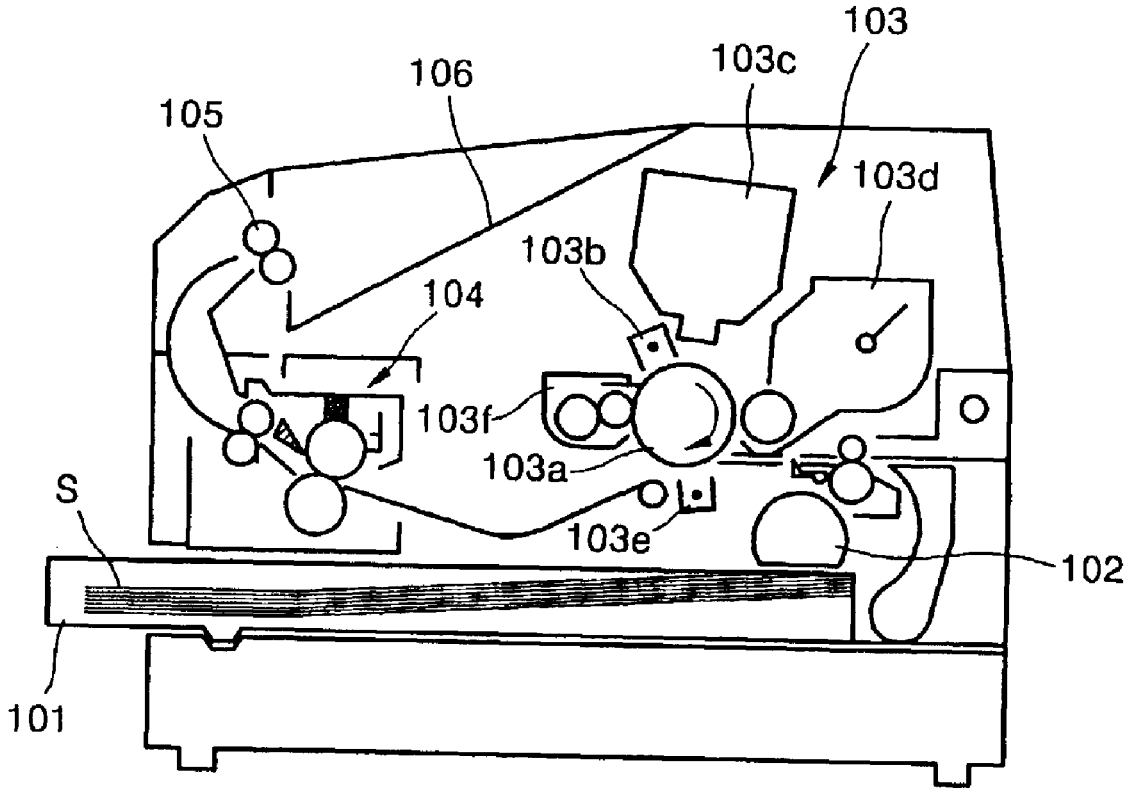
FIG. 5 shows a drum-shaped printer using the fixing apparatus according to an embodiment of the present invention.

FIG. 5 shows a drum-shaped printer using the fixing apparatus according to an embodiment of the present invention. Referring to FIG. 5, the drum-shaped printer using the fixing apparatus includes a paper feeding cassette 101 on which paper S is stacked, a paper feeding unit 102 which sequentially supplies the stacked paper S, a charging and developing unit 103 which forms an image on the supplied paper S, a transfer unit 103*e* which transfers the image developed by the charging and developing unit 103 onto the paper S, a fixing unit 104 which fixes the transferred image on the paper S, and an ejecting unit 105 which ejects the fixed paper S to the outside. A paper ejecting tray 106 which receives the ejected paper S may be connected to the ejecting unit 105.

Here, the charging and developing unit 103 includes a photosensitive drum 103*a*, a charger 103*b* which increases a surface potential of the photosensitive drum 103*a* to a charge potential, a laser scanner 103*c* which decreases part of the surface potential of the photosensitive drum 103*a* to an exposure potential to form an electrostatic latent image, and a developer 103*d* which supplies toner increased to a development potential to the photosensitive drum 103*a* to develop the electrostatic latent image. The transfer unit 103*e* is placed on the surface of the photosensitive drum 103*a* and transfers the image developed on the photosensitive drum 103*a* onto the paper S. The charging and developing unit 103 further includes a cleaner 103*f*, which eliminates toner remaining on the surface of the photosensitive drum 103*a* after a transfer step.

The fixing apparatus for a printer shown in FIGS. 3A and 3B, according to an embodiment of the present invention is used as the fixing unit 104. The structure and operation of the fixing unit 104 are the same as the above descriptions for FIGS. 4A and 4B.

Figure 6:
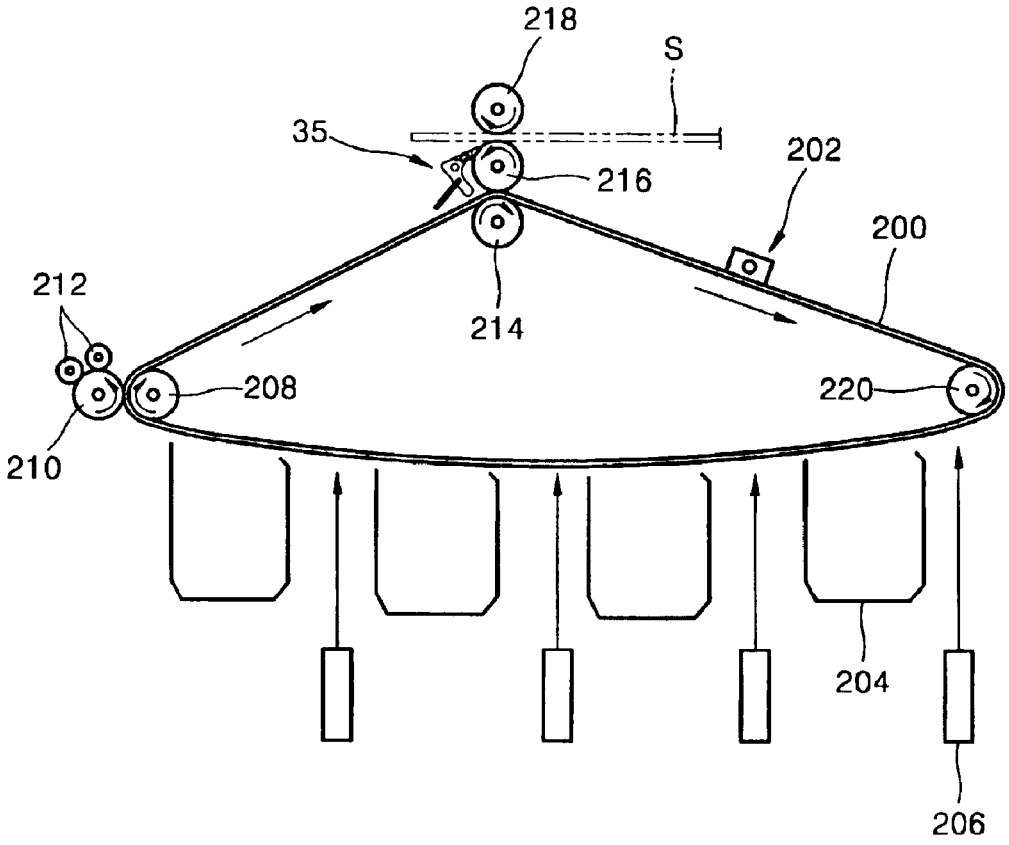
FIG. 6 shows a belt-shaped printer using the fixing apparatus according to another embodiment of the present invention.

FIG. 6 shows a belt-shaped printer using the fixing apparatus according to an embodiment of the present invention. Referring to FIG. 6, the belt-shaped printer using the fixing apparatus includes a photosensitive belt 200, a driving roller 208 which rotates and moves the photosensitive belt 200 on a given route, a backup roller 214, and a tension roller 220. A charger 202, which increases a surface potential of the photosensitive belt 200 to a charge potential, is placed on the surface of the photosensitive belt 200. A laser scanner 206, which decreases part of the surface potential of the photosensitive belt 200 to an exposure potential to form an electrostatic latent image, is placed under the photosensitive belt 200. A developer 204, which increases a toner of a predetermined color mixed with liquid carrier to a development potential, attaches the toner to a region in which the electrostatic latent image is formed, by static electricity and develops an electrostatic latent image, and is placed at one side of the laser scanner 206. The toner applied by the developer 204 is dried by a drying roller 210 and a heating roller 212 such that a toner image is formed in which only toner remains in the electrostatic latent image on the photosensitive belt 200. The toner image is transferred onto the paper S by a transfer roller 216 opposite to the backup roller 214, and the photosensitive belt 200 is placed between the backup roller 214 and the transfer roller 216. The toner image transferred onto the paper S is heated and pressed by a pressing roller 218 parallel to the transfer roller 216 at a predetermined interval.

Here, a paper separating unit 35 is installed between the transfer roller 216 and the pressuring roller 218 and separates the paper S rolled in the direction of the heating roller 218 from the surface of the pressing roller 218. The paper separating unit 35 of FIGS. 4A and 4B is used as the paper separating unit, and the structure and operation of the paper separating unit 35 are the same as described above.

A fixing apparatus for a printer according to an embodiment of the present invention employs a paper separating unit which contacts a heating roller and can effectively separate paper, thus preventing deterioration of printing quality and preventing damage to elements. Using the fixing apparatus for a printer according to the present invention, the life spans of the elements are prolonged, and the performance of a printer is improved.

As described above, in the fixing apparatus for a printer, according to the present invention, the paper separating unit that prevents damage to elements during a paper separation operation can be manufactured at low cost, prevents deterioration of image quality, provides a high quality image, and prolongs the life spans of elements, thus improving the performance of a printer.

Although a few preferred embodiments of the present invention have been shown and described, it would be appreciated by those skilled in the art that changes may be made in this embodiment without departing from the principles and spirit of the invention, the scope of which is define in the claims and their equivalents.

What is claimed is:

1. A fixing apparatus for a printer having a developing unit, the apparatus comprising:

a heating unit which fixes an image on a paper by heating the paper passing through the developing unit;

a pressing unit which contacts the heating unit, presses the paper passing through an interface with the heating unit and helps to fix the image on the paper; and a paper separating unit which includes a separation member having a sharp end contacting the heating unit to separate the paper, an arm member having one end to which the separation member is attached to pivot about a hinge shaft, which extends through the paper separating unit except for the separation member, at a predetermined angle, and an elastic member which is connected to the other end of the arm member and applies an elastic force so that the arm member is maintained in a correct position.

2. The apparatus of claim 1, wherein the separation member is a leaf spring formed of an SUS-family material strongly resistant to heat.

3. The apparatus of claim 2, further comprising polyfluoroethylene coated on the surface of the separation member.

4. The apparatus of claim 2, further comprising a polyimide film attached to a surface of the separation member.

5. The apparatus of claim 1, wherein the arm member is formed of a press type material forming a predetermined angle.

6. The apparatus of claim 1, wherein the separation member is attached to one end of the arm member, the elastic member is connected to the other end of the arm member, and the hinge shaft extends from the center of the arm member such that the arm member pivots, centering on the hinge shaft at a predetermined angle.

7. The apparatus of claim 1, wherein the heating unit is a heating roller.

8. The apparatus of claim 1, wherein the pressing unit is a pressing roller.

9. The apparatus of claim 1, wherein the pressing unit is a transfer roller.

10. The apparatus of claim 1, wherein the paper separating unit further comprises a base portion, and the sharp end extends from the base portion.

11. A fixing apparatus for a printer having a developing unit, the apparatus comprising:

an image fixing unit which heats a paper passing through the developing unit and presses the paper after heating to fix an image on the paper; and a paper separating unit which includes a separation member contacting the heating unit to separate the paper, an arm member having one end to which the separation member is attached to pivot about a hinge shaft, which extends through the paper separating unit except for the separation member, at a predetermined angle, and an elastic member which is connected to the other end of the arm member and applies an elastic force so that the arm member is maintained In a correct position.

12. The fixing apparatus of claim 11, wherein the image fixing unit comprises:

a heating unit which fixes the image on the paper by heating the paper passing through the developing unit; and a pressing unit which contacts the heating unit, presses the paper passing through an interface with the heating unit and helps to fix the image on the paper.

13. The apparatus of claim 12, wherein the heating unit is a heating roller.

14. The apparatus of claim 11, wherein the separation member is a leaf spring formed of an SUS-family material strongly resistant to heat.

15. The apparatus of claim 14, further comprising polyfluoroethylene coated on a surface of the separation member.

16. The apparatus of claim 14, further comprising a polyimide film attached to a surface of the separation member.

17. The apparatus of claim 11, wherein the arm member is formed of a press type material forming a predetermined angle.

18. The apparatus of claim 11, wherein the separation member is attached to one end of the arm member, the elastic member is connected to the other end of the arm member, and the hinge shaft extends from the center of the arm member such that the arm member pivots, centering on the hinge shaft at a predetermined angle.

19. The apparatus of claim 11, wherein the pressing unit is a pressing roller.

20. The apparatus of claim 11, wherein the pressing unit is a transfer roller.

21. A fixing apparatus for a printer having a developing unit, the apparatus comprising:

a fixing unit, which heats a paper passing through the developing unit, presses the paper after heating to fix an image on the paper, and separates the paper from the fixing unit via a paper separating unit, the paper separating unit including a separation member contacting the heating unit to separate the paper, an arm member having one end to which the separation member is attached to pivot about a hinge shaft, which extends through the paper separating unit except for the separation member, at a predetermined angle, and an elastic member which is connected to the other end of the arm member and applies an elastic force so that the arm member is maintained in a correct position.

22. The fixing apparatus of claim 21, wherein the fixing unit comprises:

a heating unit which fixes the image on the paper by heating the paper passing through the developing unit; and a pressing unit which contacts the heating unit, presses the paper passing through an interface with the heating unit and helps to fix the image on the paper.

23. The fixing apparatus of claim 22, wherein the separation member is a leaf spring formed of an SUS-family material strongly resistant to heat.

24. The fixing apparatus of claim 23, further comprising polyfluoroethylene coated on a surface of the separation member.

25. The fixing apparatus of claim 23, further comprising a polyimide film attached to a surface of the separation member.

26. The fixing apparatus of claim 22, wherein the arm member is formed of a press type material forming a predetermined angle.

27. The fixing apparatus of claim 22, wherein the separation member is attached to one end of the arm member, the elastic member is connected to the other end of the arm member, and the hinge shaft extends from the center of the arm member such that the arm member pivots, centering on the hinge shaft at a predetermined angle.

28. The fixing apparatus of claim 22, wherein the heating unit is a heating roller.

29. The fixing apparatus of claim 22, wherein the pressing unit is a pressing roller.

30. The fixing apparatus of claim 22, wherein the pressing unit is a transfer roller.

31. The fixing apparatus of claim 22, wherein the elastic member is a helicoidal spring that applies an elastic force to the other end of the arm member to which the separation member is not attached and transfers the elastic force to the separation member through the arm member such that the separation member continuously contacts the surface of the heating unit.

* * * * *

UNITED STATES PATENT AND TRADEMARK OFFICE

CERTIFICATE OF CORRECTION

PATENT NO. : 6,909,870 B2
DATED : June 21, 2005
INVENTOR(S) : Bong-hee Lee

It is certified that error appears in the above-identified patent and that said Letters Patent is hereby corrected as shown below:

Title page,
Item [56], References Cited, U.S. PATENT DOCUMENTS,
below "5,532,810" insert -- 5,623,720* 04/1997 Howe et al. 399/323 --;
below "6,205,316" insert -- 6,293,545* 09/2001 Hanks et al. 271/311 --;
below "6,490,428" insert -- 6,782,229* 08/2004 Kurisu et al. 399/323 --;
and insert
-- FOREIGN PATENT DOCUMENTS

EP 0871084 A2* 10/1998 --.

Column 6,
Line 49, change "In" to -- in --.

Signed and Sealed this

Second Day of May, 2006

JON W. DUDAS
*Director of the United States Patent and Trademark Office*